United States Patent [19]

Garcia-Crespo

[11] 4,281,587

[45] Aug. 4, 1981

[54] HYDRAULIC APPARATUS FOR PRODUCING IMPACTS

[76] Inventor: Jose T. Garcia-Crespo, Llansá, 45 - 10° 2ª, Barcelona, Spain

[21] Appl. No.: 26,227

[22] Filed: Apr. 2, 1979

[30] Foreign Application Priority Data

Mar. 31, 1978 [ES] Spain ..... 469.097

[51] Int. Cl.³ ..... F01L 25/04

[52] U.S. Cl. ..... 91/290

[58] Field of Search ..... 91/290–295, 91/301–304, 309; 60/371

[56] References Cited

U.S. PATENT DOCUMENTS

| | | | |
|---|---|---|---|
| 3,942,322 | 3/1976 | Hammarstrand | 60/371 |
| 4,020,744 | 5/1977 | Swenson | 91/216 B |

*Primary Examiner*—Leonard D. Christian

*Attorney, Agent, or Firm*—Wenderoth, Lind & Ponack

[57] ABSTRACT

A hydraulic apparatus for generating impacts comprising primary members having striking and control apparatus which is made up of a plunger which moves reciprocatingly, for striking a tool, inside a housing having an intermediate working zone which has a single inner diameter. An intermediate part making up a piston of the plunger fits therein and has a corresponding single diameter. There is no flow of fluid between these two members and the movement of the plunger is controlled by secondary members and tertiary members which are located in respective housings which make up several chambers, and in which the corresponding plungers are reciprocatingly movable. The apparatus further includes means for discharging the fluid under pressure from within the apparatus for stopping its operation when the tool is not at rest on a workpiece so that the main plunger descends inside the housing to a point below its normal lower operating position.

8 Claims, 3 Drawing Figures

HYDRAULIC APPARATUS FOR PRODUCING IMPACTS

BACKGROUND OF THE INVENTION

The present invention is directed to a hydraulic apparatus for generating impacts, commonly known as a hydraulic hammer and which is used especially in Civil Engineering.

Different types of hydraulic hammers are known which generally include an operating hydraulic having a plunger reciprocatingly movable therein, and a distributing or controlling member which does the same. Generally speaking, in the presently known hydraulic hammers, the working cylinder is made up of several actuating chambers, each having different inner diameters, such as are disclosed in British Pat. Nos. 1,161,445 and 1,160,270, and the plunger has, in correspondence with these chambers, cross-sectional sections with differing areas for closing, opening or connecting the said chambers with each other or to other elements in the apparatus. The differing areas provide different working areas upon which the hydraulic fluid can operate for causing the plunger to move. The variations in the inner diameters in the working chambers of the working cylinder results in a more complicated construction and makes the sealing between the chambers and guiding the plunger in its movement more difficult.

Further, the presently known hydraulic hammers do not include automatic stopping devices, or include only devices for manually starting or stopping the operation, such as the hydraulic hammers disclosed in British Pat. No. 1,161,445, already cited above, and No. 1,480,753, where, in the event that the operator becomes distracted, the apparatus can begin operation when the tool is not set against the workpiece and, since the apparatus is operating with no load, there is a danger of it being damaged.

SUMMARY OF THE INVENTION

Thus, an object of this invention is to solve the above-described disadvantages by simplifying the operation and construction of hydraulic hammers. To accomplish this object the diameter of the inner working zone in the hydraulic cylinder is made constant throughout so that the inner area of the cylinder can be more easily machined.

Another object of the present invention is to provide a hydraulic hammer which has the working zone in the hydraulic cylinder of a single inner diameter and the plunger, which is reciprocatingly movable within said cylinder, is made up of several parts of differing diameters which define the working chambers and the different working zones of the plunger on which the hydraulic fluid operates.

An additional object of the present invention is to provide a hydraulic hammer which includes an automatic stopping or shutting down device for only allowing the apparatus to operate when the tool is set against the workpiece which stops the operation thereof when the tool is taken away from the workpiece without requiring the operator to intervene.

Still another object of the present invention is to prevent fluid flow longitudinally along the plunger.

The hydraulic apparatus of the present invention for producing impacts includes a housing having primarily members for striking and controlling and which include a primary housing having a primary plunger which is reciprocatingly movable therein. Secondary members for controlling include a secondary housing having a secondary plunger which is reciprocatingly movable therein, and tertiary members for controlling, the tertiary members including a tertiary plunger which is reciprocatingly movable, a conventional hydraulic accumulator, and the tool which receives the impact from the primary plunger. The primary member consist of a cylindrical hollow space which defines two end zones having different diameters for sealing and guidance with respect to the corresponding differing diameters of the primary plunger, and an intermediate zone having a single third diameter of the primary plunger which conforms to the piston itself.

The actuating functions of the apparatus are accomplished by the piston of the primary plunger in cooperation with two single chambers which serve to power the primary plunger. The two single chambers are a driving chamber and a return chamber and have two signal intakes for control which are provided in the intermediate zone. One of the signal intakes is connected to one chamber in the housing of the secondary plunger and the other is connected to the housing of the tertiary plunger. In addition, a stop port connects a fluid under pressure inlet to a discharge line to the tank for the fluid to flow through the driving chamber when the primary plunger passes beyond the lower operating position. The above-described chamber is connected to a conventional hydraulic accumulator, to the fluid under pressure inlet and to a chamber in the housing of the secondary plunger, and the driving chamber is connected to the otherchamber in the housing of the secondary plunger. The secondary members include a cylindrical housing which defines several chambers in which the secondary plunger is reciprocatingly movable. The chambers of the cylindrical housing are connected to intakes, ports and to chambers in the primary housing, and in the tertiary housing.

The tertiary members include a cylindrical housing having several chambers defined and a tertiary plunger which is reciprocatingly movable therein, the chambers of the cylindrical housing being connected to chambers in the secondary housing and to the primary housing.

The primary hollow space presents a frictional zone having a single inner diameter where the appropriate portions of the differing diameter portions of the piston of the primary plunger are in constant tight contract and where flow of the fluid is not permitted between the primary hollow space and the primary plunger along the same. These features allow for one or several sealing gaskets to be fitted therein for avoiding inner fluid leaks.

The tertiary plunger in the apparatus receives a fluid pressure signal from fluid in the hollow space in the primary housing, as a result of the movement of the primary plunger, and moves within its housing to thereby control the secondary plunger. The movement of the secondary plunger connects, during its travel, the driving chamber to the hydraulic fluid discharge line to the tank, and thereby causes the tertiary plunger to return to its starting position for shutting off the connection between the chambers in its housing.

The hydraulic flow functions occur exclusively through the tertiary plunger and the secondary plunger, thereby eliminating any flow between the primry housing and the primary plunger. This allows for a more simple structure and greater strength of the housing body having the cylindrical primary hollow space and the primary plunger.

According to the present invention, the primary plunger descends, when it is not set against a workpiece on which it is working, to the lowest operating position wherein the stopping port is uncovered for connecting the inlet passage for the fluid under pressure to the fluid discharge line to the tank through the driving chamber. Thus, the apparatus is automatically stopped and the idle operation of the apparatus is prevented. When the tool is again set against the workpiece on which it is working, the primary plunger travels above the cited port for allowing the apparatus to continue its operation.

The second housing, in which the secondary plunger reciprocatingly travels, has four chambers, a first chamber which is connected to the signal control intake of a governor, a second chamber which is connected to the fluid discharge line to the tank, a third chamber which is connected to the driving chamber and the fourth chamber is connected to the fluid under pressure inlet, to a hydraulic accumulator to the stopping automatic port and to the return chamber. The secondary plunger connects, in an end position, the second chamber to the third chamber and in the other opposite end position connects the third chamber to the fourth chamber.

The tertiary housing which has the tertiary plunger reciprocatingly movable therein has four chambers, a first chamber which is connected to the signal control intake for governing, a second chamber which is connected to the chamber housing of the secondary plunger, which receives a governing control signal, a third chamber which is connected to a chamber of the secondary plunger and which is connected to the fluid discharge line to the tank, and the fourth chamber which is connected to the chamber of the secondary plunger which is connected to the fluid under pressure inlet, in such a way that the tertiary plunger, when in an end position, does not permit communication between the four chambers and in the other opposite end position connects the second chamber to the third chamber.

According to an alternative embodiment, the secondary housing which has the reciprocatingly movable secondary plunger has five chambers, a fifth chamber which is incorporated at the end next to the described fourth chamber. The connections of the secondary housing to the chambers of the tertiary plunger are exactly the same, and the connections of the secondary housing with respect to the primary housing vary in that the first chamber is connected to the signal control intake of governor, the second chamber is connected to the fluid discharge line to the tank, the third chamber is connected to the driving chamber, the fourth chamber is connected to the fluid under pressure inlet, to the hydraulic accumulator and to the stopping automatic port, which, since it is located in the frictional zone in the primary housing, causes the described stopping or shutting down, and the fifth chamber is connected to the return chamber. The secondary plunger connecting, in an end position, the second and third chambers with each other, and also the fourth chamber to the fifth chamber, and in the other opposite end position connecting the third chamber to the fourth chamber and the fourth chamber to the fifth chamber.

The invention will now be described in detail with reverence to the accompanying drawings.

DETAILED DESCRIPTION OF THE INVENTION

Figure 1:
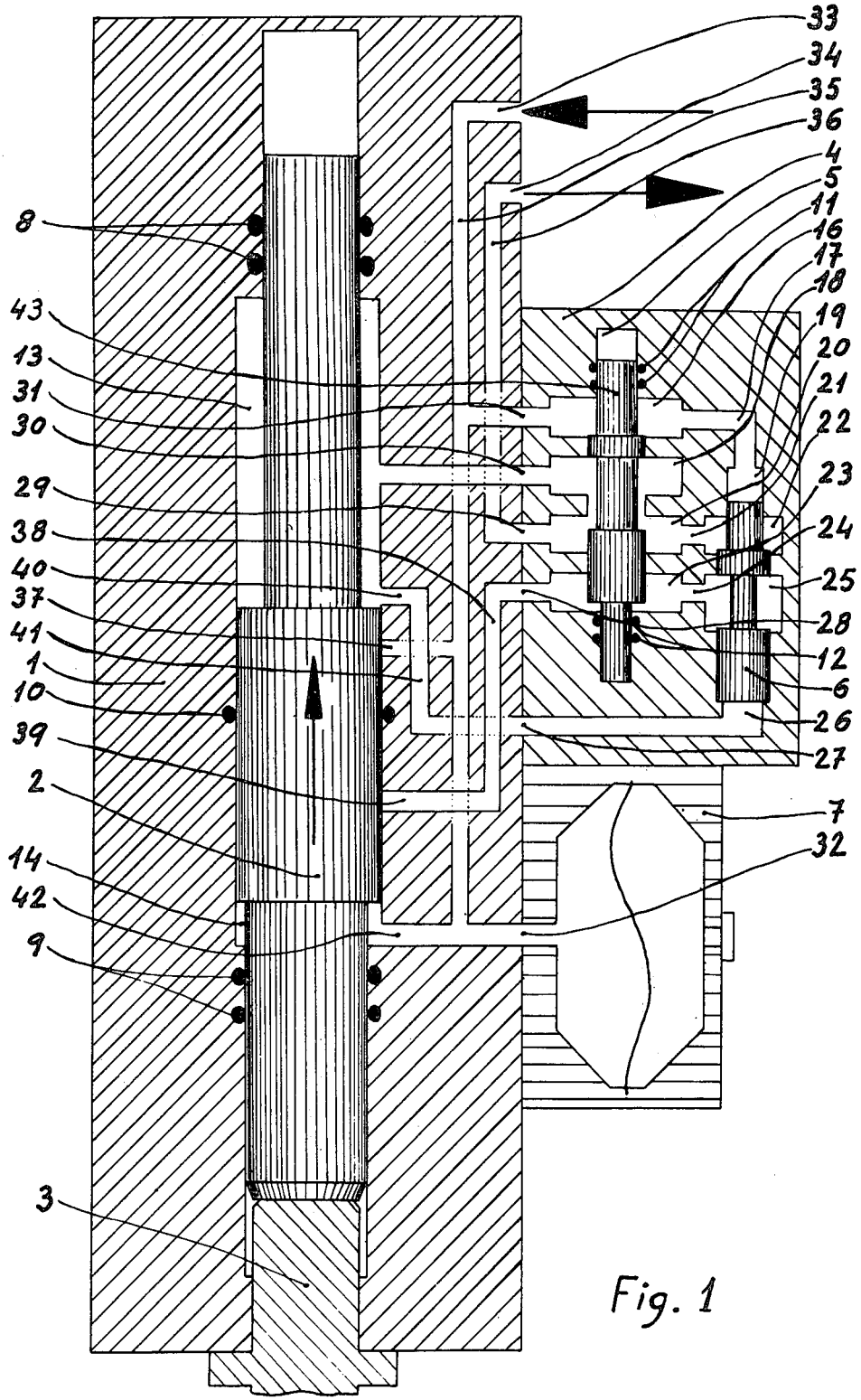
FIG. 1 is a schematic longitudinal cutaway view of the apparatus of the present invention showing its position at the start of the return stroke.

As can be seen from the drawings, the apparatus which is the subject of the present invention comprises a first body 1 which includes a primary housing having two end closing zones of different diameters and which are provided with sealing gaskets 8 and 9. There is an intermediate actuating zone which has a single diameter and wherein a main driving chamber 13 and a main return chamber 14 are defined with respect to respective three parts having different diameters of a primary plunger 2 which moves reciprocatingly within said primary housing. A tool 3 is housed within the body 1 and receives the impacts from the primary plunger 2. A second body 4 is solidly attached to the first body 1 and includes a secondary housing and a tertiary housing wherein a secondary plunger 43 and a tertiary plunger 6 respectively move reciprocatingly. The secondary housing is fitted with sealing gaskets 11 and 12. Finally, a hydraulic accumulator 7 is joined to the first body 1 in a like manner to the body 4.

The driving chamber 13 of the primary housing is connected through a passage 30 to a third chamber 18 of the secondary housing which, in turn, is connected to a second chamber 20 of the same secondary housing and this chamber is connected through the port 21 to a third chamber 22 of the tertiary housing. The driving chamber 13 is also connected through the port 29 and the passage 36 to an outlet port 34 towards a tank in a hydraulic fluid circuit. The tank is always devoid of any pressure. In addition, the driving chamber 13 of the primary housing is connected through the port 40, the passage 41 and the passage 27 to a first chamber 26 of the tertiary housing.

The return chamber 14 of the primary housing is connected through the port 42 and the passage 32 to the hydraulic accumulator 7 and through the passage 35 is connected to the inlet port 33 which connects to the fluid under pressure. The passage 35 is, in addition, connected to the intermediate part of the primary housing through the port 37, and through the port 31 to the fourth chamber 16 of the secondary housing, which, in turn, is connected through the passage 17 to a fourth chamber 19 of the tertiary housing.

The intermediate part of the primary housing is connected, in addition, through the port 39, the passage 38 and the port 28 to a first chamber 23 of the secondary housing which, in turn, is connected through the port 24 to a second chamber 25 of the tertiary housing.

The operation of the apparatus is as follows.

Figure 2:
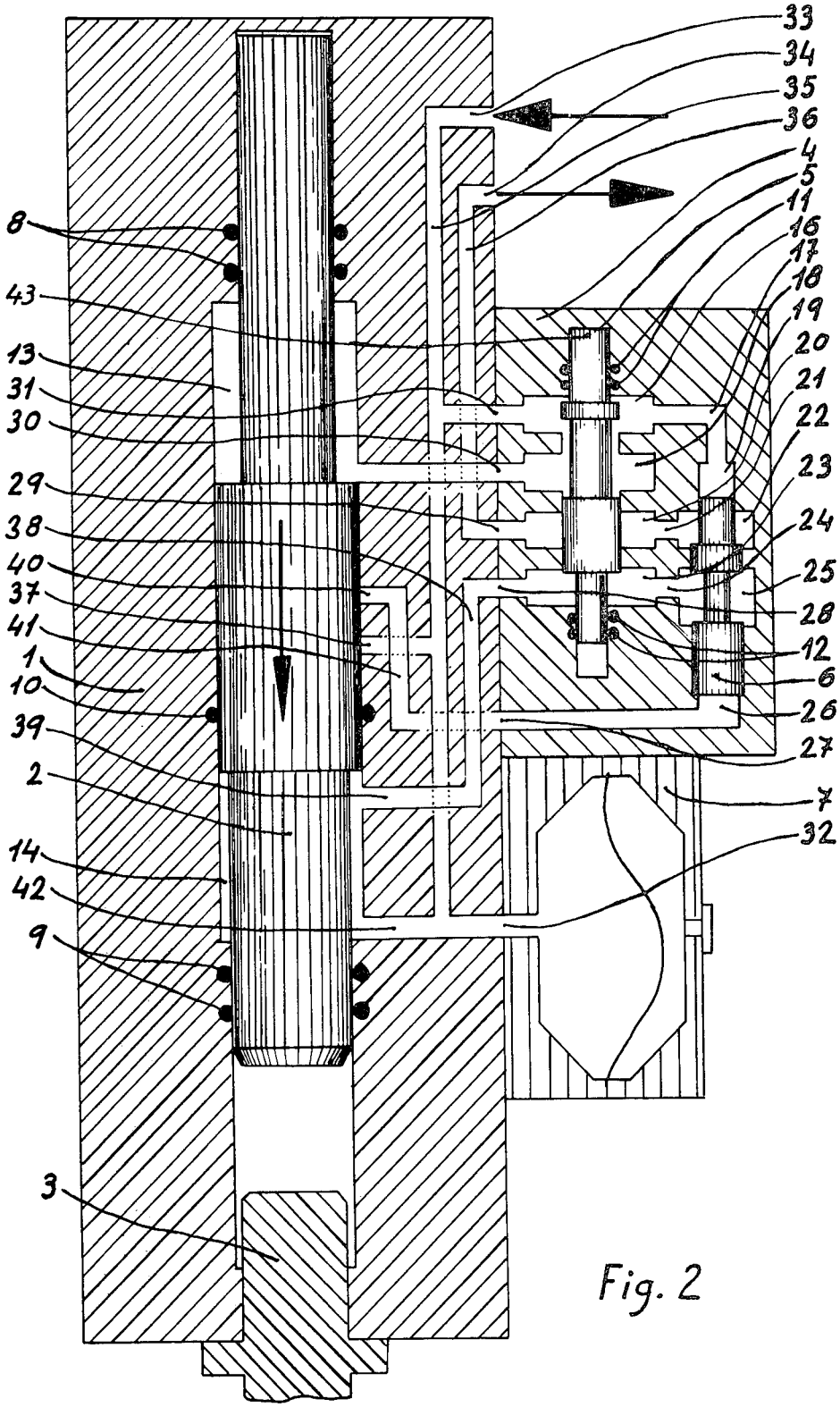
FIG. 2 is also a schematic longitudinal cutaway view of the apparatus of the present invention showing its position at the start of the driving stroke.

As can be seen from the position shown in FIG. 1, the hydraulic fluid under pressure flows into the inlet port 33 and through the passage 35 and the port 31 into the chamber 16 of the secondary housing and through the passage 17 into the chamber 19 to urge the secondary plunger 43 and the tertiary plunger 6 into the lowest position as shown in the FIG. 1. The hydraulic fluid also flows into the hydraulic accumulator 7 which is then filled with a specified volume of hydraulic fluid, and the hydraulic fluid flows through the passage 42 into the return chamber 14 of the primary housing for urging the primary plunger 2 upwards, as can be seen from the arrow in FIG. 1. This movement causes ejection of a specified volume of hydraulic fluid from the driving chamber 13 through the passage 30, chambers 18 and 20 of the secondary housing, the passage 36 and the outlet port 34 into the fluid discharge line to the tank. The primary plunger cuts off, during its upward travel, the communication of the driving chamber 13 with the port 40 and connects the return chamber 14, which is always under pressure, to the port 39, thereby causing the pressure through the passage 38 and port 28 to actuate the secondary plunger 43 in the chamber 23 of the secondary housing where it presents a greater thrusting area than in the chamber 16 where the hydraulic pressure is constantly supplied, thereby urging the secondary plunger 43 into the end position as shown in FIG. 2 and thereby connecting the chambers 18 and 16 of the secondary housing with each other and shutting off the communication of said chambers 18 and 16 with the chambers 20 and 23 so that the driving chamber 13 in which the primary plunger presents a greater thrust area than in the chamber 14 is connected to the fluid under pressure inlet through the port 30, chamber 18, chamber 16, port 31, passage 35 and port 33, to thereby stop the upwards travelling movement of the primary plunger and forcing it downwards as shown by the arrow in FIG. 2. The accumulator 7 supplies part of the hydraulic fluid necessary for the descent, said accumulator having been loaded during the upwards travel and being in communication with the chamber 13 through the port 32, passage 35, port 31, chamber 16, chamber 18, and port 30, so that, at a specified moment in the descent, the primary plunger 2 shuts off communication of the chamber 14 with the port 39 and thereby prevents the hydraulic pressure from entering the chamber 23, and afterwards allows communication between the driving chamber 13 with the port 40 so that the hydraulic fluid pressure through the passage 41 and the port 27 forces the tertiary plunger 6 upwards at the chamber 26, where it presents a greater thrusting area than in the chamber 19, which is always supplied with pressure, and thus, moving it to the other end position, which is not shown in the Figure, thereby placing the chamber 25 in communication with the chamber 22 which is connected to the discharge line of the hydraulic fluid to the tank through the port 21, chamber 20, port 29, passage 36 and port 34, thereby permitting the discharge of the hydraulic fluid in the chamber 23 into the hydraulic fluid tank. This allows the hydraulic fluid pressure which is supplied to the chamber 16 to displace the secondary plunger 43 to the other end position shown in FIG. 1. The tertiary plunger 6 returns to its position shown in FIG. 1 immediately after the secondary plunger 43 connects the chamber bers 18 and 20, thereby leaving the pressureless chamber 26 connected to the discharge line.

In this position and at the time the primary plunger has reached the lowest point in its downward travel wherein it strikes the tool 3 and passes its kinetic energy to it as a result of the velocity it has acquired from the thrust of the hydraulic fluid during its downward travel, the chamber 13 is connected to the hydraulic fluid tank through the port 30, chamber 18, chamber 20, port 29, passage 36, and outlet port 34.

In the chamber 14 there is a pressure which constantly urges the primary plunger upwards, thereby starting over the upward stroke as shown by the arrow in the FIG. 1, and thereby starting a new cycle as has already been described.

When the tool 3 is not set on the material on which it is working, as shown in the position in FIG. 3, the primary plunger descends below its lowest operating position, thereby connecting the automatic stop port 37, the port 32, the pressurized fluid inlet port 33, the passage 35, port 31, passage 42, chamber 14 to the fluid discharge line to the tank through the driving chamber 13, the port 30, the chamber 18, the chamber 20, the port 29, the passage 36 and the outlet 34, so that the accumulator is discharged into the tank, thereby leaving the return chamber 14 devoid of any pressure, which, in turn, stops the primary plunger 2.

Upon resetting the tool on the workpiece, the primary plunger 2 is brought into its lowest operating position, thereby closing off the connection of the driving chamber 13 to the port 37 and reestablishing the operating conditions which have already been described. The gaskets 8 and 9 prevent the hydraulic fluid from leaking outside of the apparatus, as well as do the gaskets 11 and 12. The gasket 10 seals the apparatus against interior leakages in the primary housing.

Figure 3:
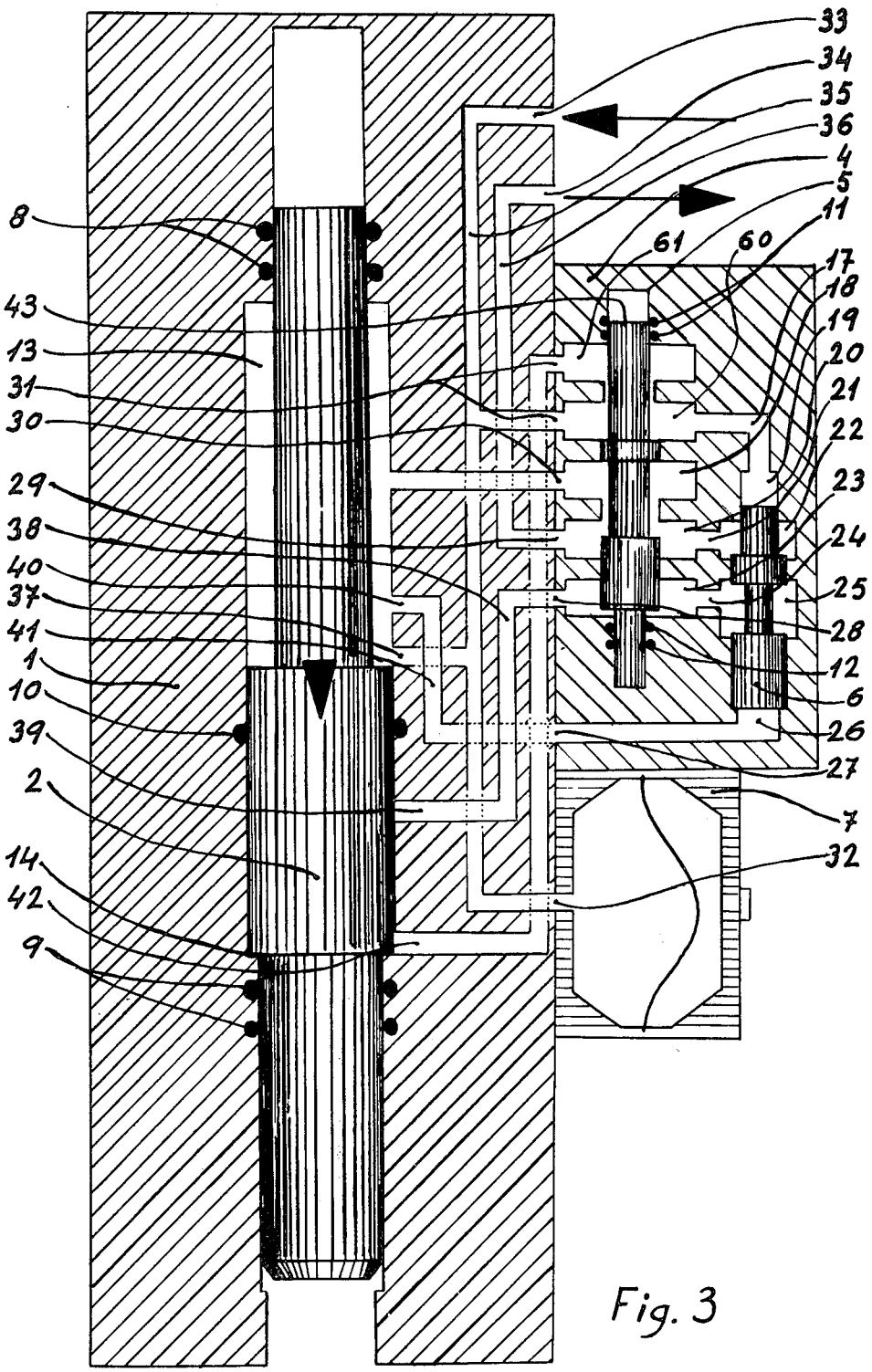
FIG. 3 corresponds to a schematic longitudinal cutaway of an alternative embodiment of the present apparatus showing its position at the time it is automatically shut down.

In the alternative embodiment shown in FIG. 3 the chamber 16 which is shown in the FIGS. 1 and 2 is divided into the chambers 60 and 61, so that the chamber 61 is connected to the chamber 60 and to the return chamber 14, and the chamber 60 is connected to the chamber 61, the chamber 19, the fluid under pressure inlet 35, the stop port 37, and the hydraulic accumulator 7, so that the connections and functions performed by the chamber 16 in the FIGS. 1 and 2 are now carried out by the two cooperating chambers 60 and 61 in FIG. 3. The other connections, operations and functions are the same as were described with reference to FIGS. 1 and 2, which permits directing the hydraulic fluid pressure to the return chamber 14 separately from the hydraulic accumulator 7.

The elements of the present invention can be of individual parts which can be assembled together.

What I claim is:

1. A hydraulic apparatus of the type known as a hydraulic hammer for generating impacts, said hydraulic apparatus comprising:

a housing having a hydraulic cylinder and plunger means received in said hydraulic cylinder, said plunger means reciprocatingly slidable within said hydraulic cylinder;

a removable percussion tool positioned adjacent said plunger means for being struck by said reciprocatingly slidable plunger means;

a first driving chamber, said driving chamber having a first chamber variable volume, said first chamber volume varying in response to a reciprocating sliding movement of said plunger and said first driving chamber defined by a first actuating surface of said plunger means and the walls of said hydraulic cylinder;

a second return chamber having a second chamber variable volume, said second chamber volume varying in a manner opposite to said first chamber volume and in response to said reciprocating sliding movement of said plunger and said second return chamber defined by a second actuating surface of said plunger means, said second actuating surface being smaller than said first actuating surface, the walls of said hydraulic cylinder and the portion of said removable percussion tool which is struck by said plunger;

distributing means having a pressurized fluid inlet and a discharge line, said distributing means connected to said first driving chamber for switching between a first condition for having pressurized fluid supplied to said first driving chamber and causing said plunger to strike said percussion tool on a first driving stroke of said reciprocating sliding movement, and a second condition for emptying said pressurized fluid through said discharge line on a second return stroke of said reciprocating sliding movement of said plunger, said pressurized fluid inlet connected permanently to said second return chamber for causing said plunger to move in said second return stroke when said distributing means is in said second condition; and stop port means permanently connected to said pressurized fluid, said stop port means being closed by said plunger means undergoing normal reciprocating sliding movement and said stop port means being open, for supplying pressurized fluid to said first chamber for stopping reciprocating sliding movement of said plunger, when said removable tool is removed and thereby causes said plunger to move a greater distance on said driving stroke than during normal reciprocating sliding movement thereof.

2. A hydraulic apparatus of the type known as a hydraulic hammer for generating impacts, said hydraulic apparatus comprising:

a primary housing having a hydraulic cylinder and primary plunger means reciprocatingly and slidably received therein, said hydraulic cylinder having first and second end zones having sealing means, and having different diameters, and said primary plunger means having corresponding diameter first and second end portions slidably received in said first and second end zones, in contact with said sealing means for sealing said end portions, said hydraulic cylinder having an intermediate zone having a third diameter and said primary plunger means having an intermediate portion having a third diameter corresponding to said intermediate zone third diameter;

a first driving chamber defined by a first end face of said intermediate portion and the walls of said intermediate zone and a second return chamber defined by a second end face of said intermediate portion and the walls of said intermediate zone, said first end face having a greater surface area than said second end face;

secondary housing means having a pressurized fluid supply and fluid outlet connected thereto, and having secondary and tertiary pluralities of chambers and corresponding secondary and tertiary plunger means reciprocatingly slidably received therein for supplying pressurized fluid to said first and second chambers and for allowing pressurized fluid flow from said first chamber for controlling the reciprocating sliding movement of said primary plunger means;

a removable percussion tool positioned at one end of said second end zone for being struck by said second portion of said primary plunger means when said primary plunger means undergoes reciprocating sliding motion;

a hydraulic accumulator means attached to said primary housing for receiving pressurized fluid from said second chamber;

first signal control intake means connected to said pressurized fluid supply and to a first chamber of said secondary plurality of chambers, second signal control intake means connected to said first chamber of said secondary plurality of chambers and to a first chamber of said tertiary plurality of chambers and a stop port means connected to said intermediate zone and to said pressurized fluid supply, for connecting said pressurized fluid supply, through said first driving chamber, to said fluid outlet for stopping reciprocating sliding movement of said primary plunger means when said removable percussion tool has been removed and said primary plunger means is at a position lower than the lowest position during normal operation;

connecting means for connecting said secondary return chamber with said hydraulic accumulator to said pressurized fluid supply and to a second chamber of said secondary plurality of chambers, said connecting means further connecting said first driving chamber to a third chamber of said secondary plurality of chambers; and interconnecting means for connecting said primary housing hydraulic cylinder to said secondary plurality of chambers, said primary housing hydraulic cylinder to said tertiary plurality of chambers and said secondary plurality of chambers to said tertiary plurality of chambers for controlling and causing said primary plunger means to undergo reciprocating sliding motion.

3. An apparatus as in claim 2 wherein said secondary plurality of chambers comprises a fourth chamber connected to said fluid outlet, said secondary plunger means being movable between first and second end positions wherein, at said first end position, said fourth chamber of said secondary plurality of chambers is connected to said third chamber of said secondary plurality of chambers, and, at said second end position, said third chamber of said secondary plurality of chambers is connected to said second chamber of said secondary plurality of chambers.

4. An apparatus as in claim 3 wherein said tertiary plurality of chambers comprises second, third and fourth chambers, said interconnecting means connecting said second, third and fourth chambers of said tertiary plurality of chambers respectively to said first, fourth, and second chambers of said secondary plurality of chambers, said tertiary plunger means movable between first and second end positions wherein, at said second end position, said second chamber of said tertiary plurality of chambers is connected to said third chamber thereof, and, at said first end position, none of said chambers of said tertiary plurality of chambers are connected.

5. An apparatus as in claim 2 wherein said secondary plurality of chambers further comprises a fifth chamber wherein when said secondary plunger means is in said first end position, said fourth chamber of said secondary plurality of chambers is connected to said third chamber thereof and said second chamber thereof to said fifth chamber thereof and, at said second end position, said secondary plurality of chambers fifth chamber is connected to said second chamber thereof, and said third chamber thereof is connected to said second chamber thereof.

6. An apparatus as in claim 2 wherein said primary plunger means is positioned for maintaining said stop port means closed during normal reciprocating sliding movement of said primary plunger, and positioned for opening said stop port means when said percussion tool is removed and said primary plunger means moves below the lowest normal operating position.

7. An apparatus as in claim 1 or 2 further comprising a seal means located in the walls of said hydraulic cylinder for sealing off fluid flow between said first driving chamber and secondary return chamber.

8. An apparatus as in claim 7 wherein said seal means comprises a gasket.

* * * * *